US010480726B1

(12) United States Patent
Zhang

(10) Patent No.: US 10,480,726 B1
(45) Date of Patent: Nov. 19, 2019

(54) MODULAR LED LAMP SYSTEM

(71) Applicant: Kanghong Zhang, Santa Fe Springs, CA (US)

(72) Inventor: Kanghong Zhang, Santa Fe Springs, CA (US)

( * ) Notice: Subject to any disclaimer, the term of this patent is extended or adjusted under 35 U.S.C. 154(b) by 0 days.

(21) Appl. No.: 16/411,032

(22) Filed: May 13, 2019

Related U.S. Application Data

(63) Continuation-in-part of application No. 16/036,139, filed on Jul. 16, 2018, now Pat. No. 10,323,805.

(60) Provisional application No. 62/671,019, filed on May 14, 2018.

(51) Int. Cl.
*F21S 2/00* (2016.01)
*F21V 23/06* (2006.01)
*F21V 23/00* (2015.01)

(52) U.S. Cl.
CPC ..... *F21S 2/005* (2013.01); *F21V 23/002* (2013.01); *F21V 23/004* (2013.01); *F21V 23/06* (2013.01)

(58) Field of Classification Search
CPC ..... F21S 2/005; F21V 23/004; F21V 23/002; F21V 23/06
See application file for complete search history.

(56) References Cited

U.S. PATENT DOCUMENTS

2010/0102729 A1* 4/2010 Katzir ..... H05B 33/0803 315/113
2011/0291569 A1* 12/2011 Shin ..... F21V 3/02 315/113
2013/0050997 A1* 2/2013 Bretschneider ..... F21S 2/005 362/190
2013/0141890 A1* 6/2013 Carlin ..... F21V 23/026 362/20
2014/0247585 A1* 9/2014 Chien ..... F21V 19/003 362/217.17
2016/0081147 A1* 3/2016 Guang ..... H05B 33/0803 315/123

* cited by examiner

*Primary Examiner* — Donald L Raleigh
(74) *Attorney, Agent, or Firm* — Clement Cheng

(57) ABSTRACT

A modular LED lamp system has a cover. A driver is mounted to either a first driver mount or a second driver mounting area. An LED array is mounted to a circuit board, and the circuit board includes a first driver mount. The system has a left electrical connector, and a right electrical connector. The second driver mount is formed on the left electrical connector or is formed on the right electrical connector. The driver can be mounted to either the first driver mount or the second driver mount. The cover can be either plastic or glass. The LED array mounted to a circuit board is elongated. The first driver mount and the second driver mount are slot shaped.

20 Claims, 3 Drawing Sheets

MODULAR LED LAMP SYSTEM

This application is a non-provisional of and claims priority from provisional application 62/671,019 filed May 14, 2018, by same inventor Kanghong Zhang entitled Modular LED Lamp System.

This application is a continuation in part of co-pending utility patent application Ser. No. 16/036,139 filed Jul. 16, 2018 by same inventor Kanghong Zhang entitled Modular LED Tube Lamp.

FIELD OF THE INVENTION

The present invention is in the field of modular LED lamp systems.

DISCUSSION OF RELATED ART

Traditionally, fluorescent lamps have been made in tubes and mounted in lighting fixtures. As lighting is transitioning to LED lamps, replacement lights have been converted to LED technology. LED stands for light-emitting diode.

SUMMARY OF THE INVENTION

A modular LED lamp system has a cover. A driver has the option to be mounted to either a first driver mount or a second driver mounting area on a right or left side. An LED array is mounted to a circuit board, and the circuit board includes a first driver mount. The system has a left electrical connector, and a right electrical connector. The second driver mount is formed on the left electrical connector or is formed on the right electrical connector. The driver can be mounted to either the first driver mount or the second driver mount. The cover can be either plastic or glass. The LED array mounted to a circuit board is elongated. The first driver mount and the second driver mount are slot shaped.

Therefore, a lamp body could be an LED array that is functioning with or without drivers. The end cap could be either with or without a driver circuit. Accordingly, the modular nature of the lamp system allows rapid manufacturing. The modular LED lamp system preferably includes a tubular cover.

A driver is mounted to either a first driver mount or a second driver mount. The driver has both a mechanical and electrical connection to either the first driver mount in a first mode or the second driver mount in a second mode.

A circuit board preferably includes an LED array mounted to the circuit board. The circuit board includes a first driver mount. A left electrical connector body connects to a left end of the cover, and a right electrical connector body, wherein a second driver mount is formed on either the left electrical connector body, or the right electrical connector body, wherein the driver is mounted to the first driver mount in a first mode or the second driver mount in a second mode.

The circuit board fits in a slot formed on the cover. The circuit board has a pair of indents including a first snap retainer indent and a second snap retainer indent. A first snap retainer is formed on the cover and engages the first snap retainer indent. A second snap retainer is formed on the cover and engages the second snap retainer indent. The circuit board has a first driver module formed on the first driver module. The first driver module has a first driver module snap retainer indent and a second driver module snap retainer indent. The first driver module snap retainer indent engages to a first driver module snap retainer formed on the cover, and the second driver module snap retainer indent engages to a second driver module snap retainer formed on the cover.

Optionally, the cover is can be plastic or glass. The LED array is mounted to a circuit board and is elongated. The first driver mounting area and the second driver mounting area are slot shaped. The left electrical connector body has a snap connection with the cover. The right electrical connector body has a snap connection with the cover, and the circuit board has a snap connection to the cover.

A left electrical connector first socket formed on the circuit board receives a left electrical connector first inside contact formed on the left electrical connector body and a left electrical connector second socket formed on the circuit board receives a left electrical connector second inside contact formed on the left electrical connector body. A right electrical connector first socket formed on the circuit board receives a right electrical connector first inside contact formed on the right electrical connector body and a right electrical connector second socket formed on the circuit board receives a right electrical connector second inside contact formed on the right electrical connector body. Snap hooks preferably retain the left electrical connector body and the right electrical connector body to the circuit board to maintain electrical contact.

The following call out list of elements can be a useful guide in referencing the element numbers of the drawings.

21 Circuit Board Left Driver Mount
22 Circuit Board With Led Array
23 Cover
24 Left Circuit Board Connector
25 Right Circuit Board Connector
26 Driver
27 Circuit Board Driver Mount Electrical Bypass
28 Circuit Board Right Driver Mount
30 Left Electrical Connector
31 Left Electrical Connector Outside Contact
32 Left Electrical Connector Body
33 Left Electrical Connector First Inside Contact
34 Left Electrical Connector Second Inside Contact
35 Left Electrical Connector Driver Mount
36 first driver mount location
37 second driver mount location
38 third driver mount location
39 fourth driver mount location
40 Right Electrical Connector
41 Right Electrical Connector Outside Contact
42 Right Electrical Connector Body
43 Right Electrical Connector First Inside Contact

44 Right Electrical Connector Second Inside Contact
45 Right Electrical Connector Driver Mount
51 Left Electrical Connector Second Socket
52 Left Electrical Connector First Socket
53 Right Electrical Connector Second Socket
54 Right Electrical Connector First Socket
55 Right Electrical Connector Second Connection Area
56 Right Electrical Connector First Connection Area
57 Right Electrical Connector Second Snap Hook
58 Right Electrical Connector First Snap Hook
60 Snap Retainer
61 First Snap Retainer
62 Second Snap Retainer
63 First Snap Retainer Indent
64 Second Snap Retainer Indent
65 First Driver Module Snap Retainer
66 First Driver Module Snap Retainer Indent
67 Second Driver Module Snap Retainer
68 Second Driver Module Snap Retainer Indent
71 Left Electrical Connector First Snap Hook
72 Left Electrical Connector First Connection Area
73 Left Electrical Connector Second Snap Hook
74 Left Electrical Connector Second Connection Area
75 Circuit Plug
76 Circuit Socket
77 Cover Slot
78 Translucent Upper Portion
79 Opaque Lower Portion
80 Cover Right End
81 Cover Left End
82 Right Electrical Connector Body Inside Switch
83 Left Electrical Connector Body Inside Switch
84 Circuit Board Driver Mount Plug
85 Circuit Board Driver Mount Socket

DETAILED DESCRIPTION OF THE PREFERRED EMBODIMENT

Figure 1:
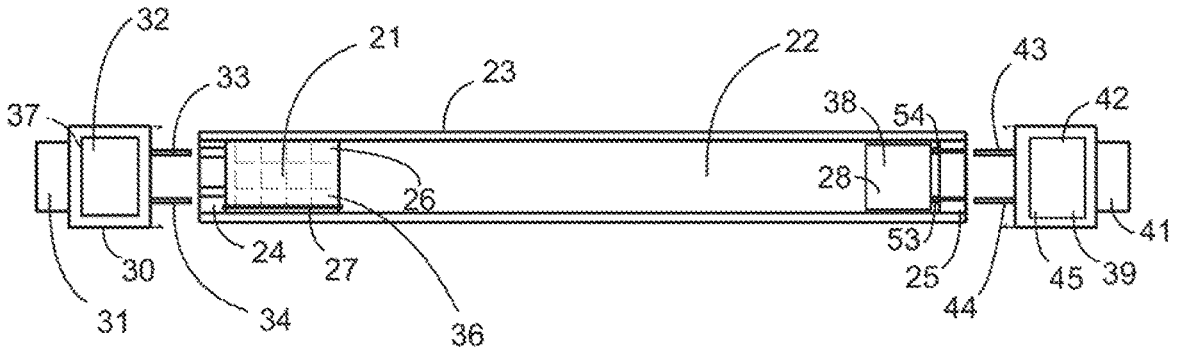
FIG. 1 is a diagram of the present invention.
Figure 2:
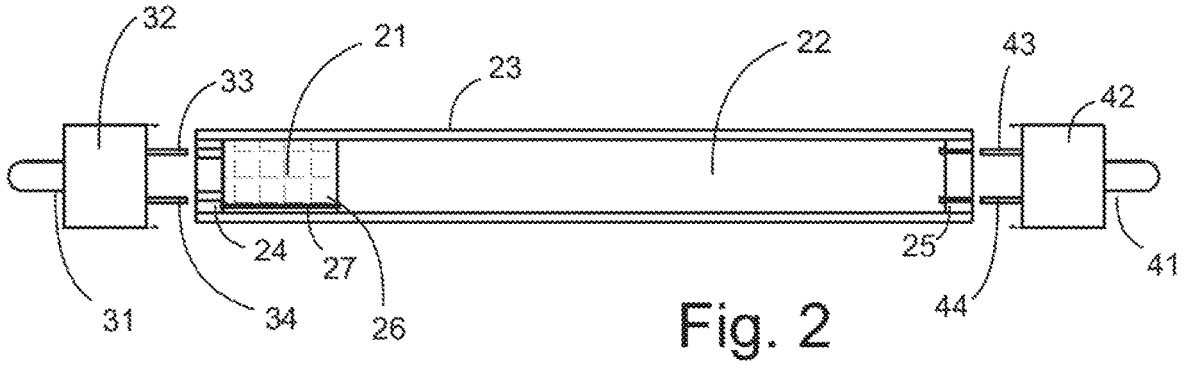
FIG. 2 is a diagram of the present invention.
Figure 3:
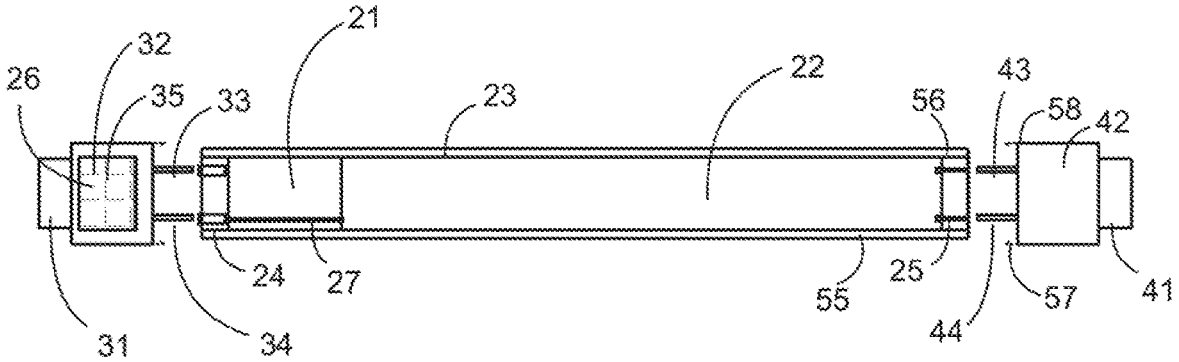
FIG. 3 is a diagram of the present invention.

As seen in FIGS. 1-3, the present invention allows fast and flexible manufacturing of LED lamp systems through a modular approach. The LED lamp has a cover such as a glass tube or a plastic cover 23. The cover 23 can be sprayed or laminated with a coating. The LED driver is mounted to a circuit board and has a pluggable electrical connection to an LED lamp connector of a type such as G13, FA8, G5, R17d, or G6.6. The lamp connector modularly connects to the LED driver on the circuit board. The lamp connector is formed as an end cap that covers an open end of the coating.

The assembly generally involves five separate pieces or parts. The first piece is the cover 23. The second piece is the circuit board with the LED array 22. The third piece is the driver 26, the fourth piece is the left electrical connector 30, and the fifth piece is the right electrical connector 40.

The user can mix-and-match the modular pieces to create different types of lamps depending upon customer requirements. Different customers may have different technical specifications such as voltage, lighting color, and the like. The manufacturing process can be done in less than a minute because the pieces snap together. Manually snapping the pieces together allows manufacturing to occur in about ten seconds.

The system has two locations for mounting a driver on the right side and another two mounting locations on a left side for a total of four different mounting locations. The driver 26 can be mounted on the circuit board or in the electrical connector such as the left electrical connector 30 or the right electrical connector 40. The left circuit board driver mounting location 21 is adjacent to the LED array. The left circuit board driver mounting location 21 is on the circuit board with LED array 22. The LED array can be a COB or independent element array. The cover 23 snaps to the circuit board and has a left and right opening. The left and right opening are covered by the left electrical connector 30 and the right electrical connector 40 respectively. The cover 23 preferably includes UV treatment for limiting transmission of ultraviolet light. The driver 26 can be separated into multiple modular parts so that the first part is mounted in a first mounting location and a second part is mounted in a second mounting location.

The left electrical connector 30 has a left electrical connector outside contact 31 that connects to the lighting fixture that the lamp is mounted in. Similarly, the right electrical connector 40 has a right electrical connector outside contact 41 that connects to the lighting fixture that the lamp is mounted in. The left electrical connector 30 has a left electrical connector body 32 and the right electrical connector 40 has a right electrical connector body 42. The electrical connector bodies preferably include electrical terminals or contacts for connecting to a lamp apparatus.

The left circuit board driver mount 21 and the left electrical connector driver mount 35 can be formed as sockets for receiving the driver 26. The sockets can be slot shaped. When the driver 26 is not operational on the left electrical connector driver mount 35, a circuit board driver mount electrical bypass 27 bypasses the nonoperational driver in the left electrical connector driver mount 35. The driver can be in the shape of a flat card.

Preferably, the circuit board with the LED array 22 has a pair of notches for engaging to snap retainers 60 formed on the cover 23. For example, a first snap retainer 61 can engage a first snap retainer indent 63, and a second snap retainer 62 can engage a second snap retainer indent 64. The driver module also preferably has snap retainers 60 for retaining the driver module to the cover 23. For example, a first driver module snap retainer 65 can engage a first driver module snap retainer indent 66, and a second driver module snap retainer 67 can engage a second driver module snap retainer indent 68. The snap retainers 60 provide a plugging capability between the LED lamp modules, such as between the driver and the circuit board with LED array 22.

The left electrical connector 30 has a pair of inside contacts which includes the left electrical connector first inside contact 33 and the left electrical connector second inside contact 34. The pair of electrical connectors can be formed as pins that insert into a left circuit board connector 24. The left circuit board connector 24 can be formed as a pair of electrical sockets or pins packaged in a single left electrical circuit board connector socket body which is then soldered or otherwise electrically connected to the circuit board.

Similarly, the right circuit board connector 25 can be electrically connected such as being soldered to the circuit board. The right circuit board connector 25 can also be formed as a pair of sockets or pins that connect to the right electrical connector first inside contact 43 and the right electrical connector second inside contact 44. The left circuit board connector 24 connects to the left electrical connector first inside contact 33 and left electrical connector second inside contact 34. The right circuit board connector 25 connects to the right electrical connector first inside contact 43 and right electrical connector second inside contact 44.

Figure 4:
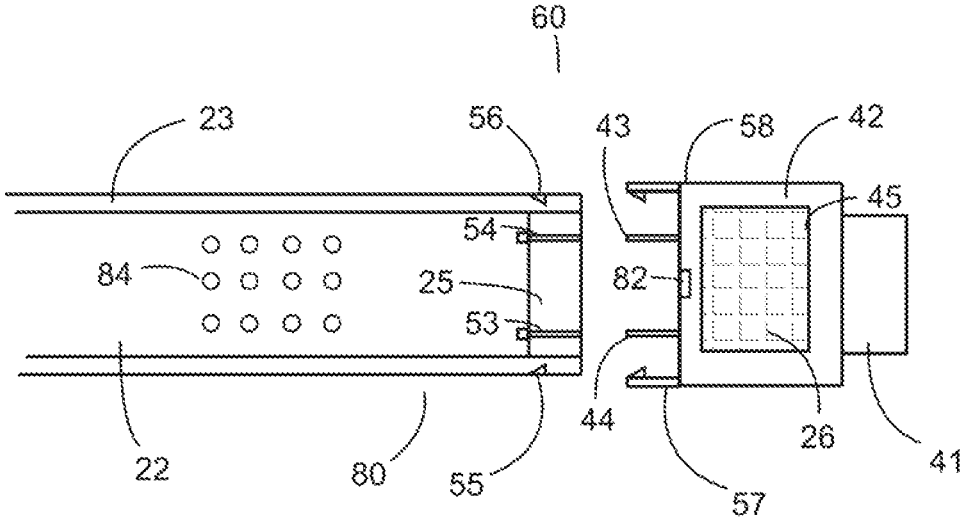
FIG. 4 is a diagram of the electrical and mechanical connections for the right electrical connector body on the cover right end 80.
Figure 5:
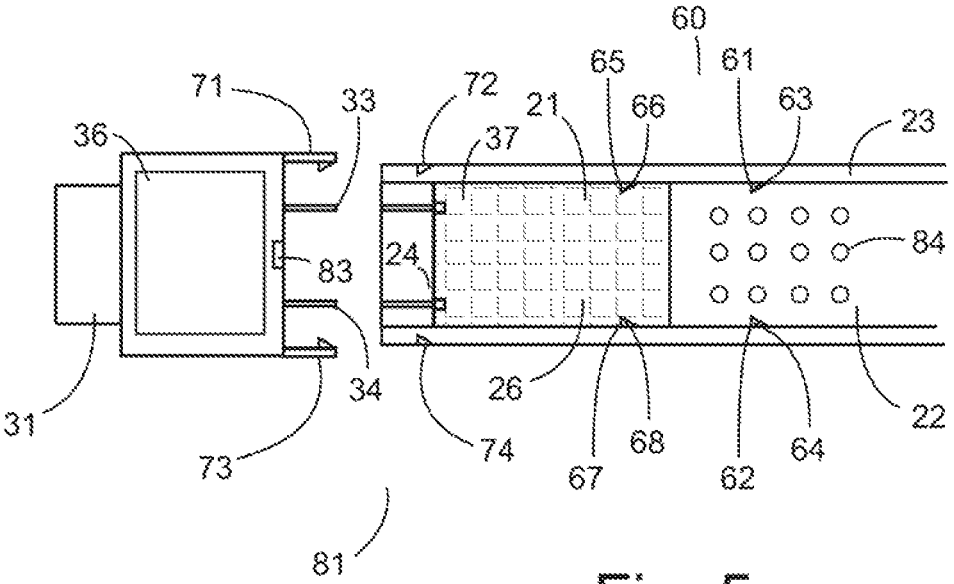
FIG. 5 is a diagram of the electrical and mechanical connections for the left electrical connector body on the cover left end 81.

As seen in FIG. 4, the left electrical connector first socket 52 and left electrical connector second socket 51 respectively receive the left electrical connector first inside contact 33 and the left electrical connector second inside contact 34. The cover right end 80 receives the right electrical connector body 42. Similarly, the right electrical connector second socket 53 and the right electrical connector first socket 54 receive the right electrical connector first inside contact 43 and the right electrical connector second inside contact 44. The electrical contacts are made at the same time that the physical snap fit connection is made. The right circuit board connector 25 can have a pair of electrical contacts that electrically engage the right electrical connector first socket 54 and the right electrical connector second socket 53.

A depression such as a triangular indent for receiving a snap hook can be made in a right electrical connector first connection area 56 and a right electrical connector second connection area 55. The right electrical connector first snap hook 58 is preferably configured to engage the right connector first connection area 56 while the right electrical connector second snap hook 57 engages the right electrical connector second connection area 55. The electrical connector areas can be made as indents formed on the cover 23, and the engagement hooks can be formed on the right electrical connector body 42.

Figure 6:
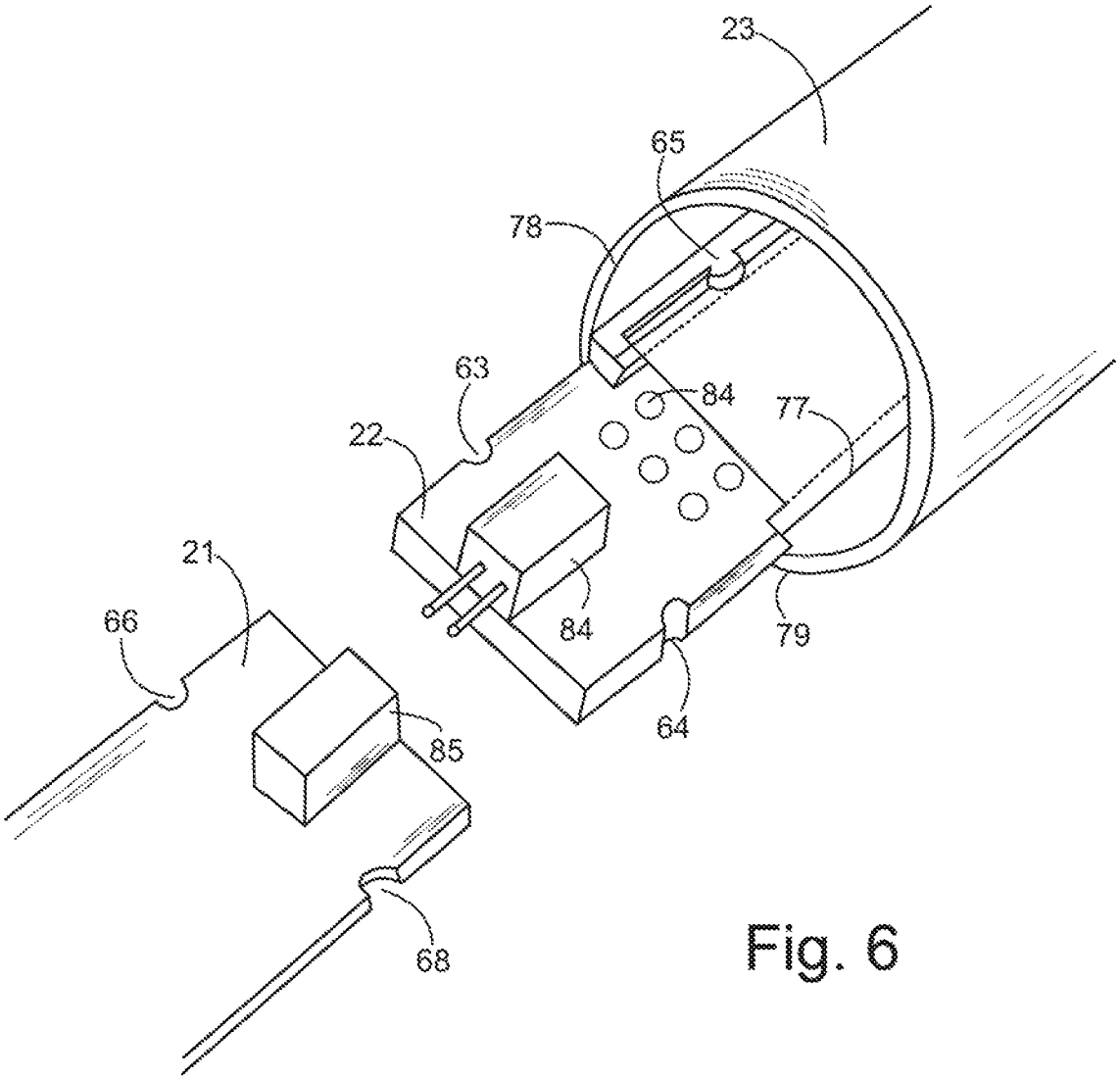
FIG. 6 is a perspective view drawing of the circuit board with LED array being inserted into the cover.

Similarly, as seen in FIG. 6, the cover left end 81 receives the left electrical connector body 32. A left electrical connector first snap hook 71 engages a left electrical connector first connection area 72 and a left electrical connector second snap hook 73 engages a left electrical connector second connection area 74 so that the left electrical connector second socket 51 and the left electrical connector first socket 52 receive respectively the left electrical connector first inside contact 33 and the left electrical connector second inside contact 34. The engagement hooks retain the electrical connectors within the sockets. The electrical connector areas can be made as indents formed on the cover 23, and the engagement hooks can be formed on the left electrical connector body 32.

During final assembly, a user picks a tube cover 23 with the slot having the snap connector system and the user inserts the LED panel to snap the panel in place, then the user picks the driver circuit and snaps that into place next to the LED panel. The user then snaps the left electrical connector body 32 and the right electrical connector body 42 so as to complete the five piece construction. Final assembly thus does not require any soldering because the pieces fit together like toy bricks.

As seen in FIG. 6, the circuit plug 75 engages a circuit socket 76 so that the left circuit board driver mount 21 is electrically connected to the circuit board with LED array 22 when both of the boards are inserted into the cover slot 77. Here, the left circuit board driver mount 21 is on a separate circuit board from the circuit board with LED array 22, but the circuit board driver mount 21 connects to the circuit board with LED array 22 so that they both become one circuit board. Thus, the circuit board with LED array 22 can be formed in modular segments. The snap hooks are preferably rounded so that they retain, but not lock so that the first circuit board can be pushed past the first set of snap hooks such as the first driver module snap retainer 65, which may engage first with the first snap retainer indent 63, but then the user can press the circuit board with LED array 22 past the first driver module snap retainer 65 to disengage the snap retainer and reengage it to the first driver module snap retainer indent 66. Preferably, the slot is not excessively tight so as to allow quick assembly, but not so loose that the components rattle or have excessive play. The snap retainers can be recessed within the slot and have rounded hook ends. The slot can be integrally formed in the cover 22 which functions as a housing. The cover 22 can be made of multiple parts such as a translucent upper portion 78 of polycarbonate or glass and an opaque portion lower portion 79 such as PVC or aluminum.

The cover right end 80 preferably includes a right electrical connector body inside switch 82 and the cover left end 81 preferably includes a cover left end inside switch 83. The electrical connector body inside switches are obscured when the right electrical connector body or the left electrical connector body are connected to either end of the cover. The LED chips 84 can be mounted in an array on the circuit board with LED array 22.

Preferably, the driver is directly mounted to the PCB board (printed circuit board) portion of the circuit board with LED array 22 instead of being formed from separate boards. However, as an option, as seen in FIG. 6, a circuit board driver mount plug 84 can modularly engage to a circuit board driver mount socket 85. The circuit board driver mount plug 84 and circuit board driver mount socket 85 can be mounted to separate physical circuit boards to connect together the circuit board with LED array 22 when the circuit board with LED array 22 is formed from two separate boards. The left or right inside switch can be used to select which location the driver is mounted to. For example, the inside switch can have a first position corresponding to activation of a driver when the driver is mounted to the first driver mount in a first mode. Alternatively, the inside switch can have a second position corresponding to activation of the driver when the driver is mounted to the second driver mount in a second mode. First driver mount and the second driver mount are preferably electrically connected in parallel so that the driver can be mounted to either the first driver mount for the second driver mount.

The four different locations for the driver mount include a first driver mount location 36, a second driver mount location 37, a third driver mount location 38, and a fourth driver mount location 39. The first driver mount location 36 can be located in the left electrical connector body 32. The second driver mount location 37 can be located in the circuit board left driver mount 21. The third driver mount location 38 can be located at the circuit board right driver mount 28. The fourth driver mount location 39 can be located in the right electrical connector driver mount 45 formed on the right electrical connector body 42. Optionally, one complete driver can fit in any of the four locations, two halves of a driver can fit in any of the two locations, three thirds of a driver can fit in any of the three locations, and four quarters of a driver can fit in any of the four locations. Different portions of the driver circuitry can be standardized in modules so that additional driver functionality can be added by plugging additional driver parts to the different driver mount locations. The four driver mounting locations are electrically interconnected to facilitate their selective usage.

Figure 7:
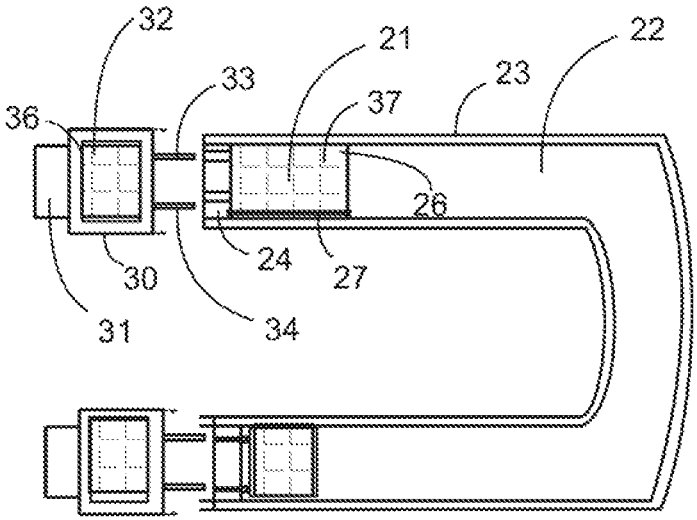
FIG. 7 shows a U shaped embodiment with the driver that is implemented in four different modules but are still electrically connected when the present invention is fully assembled.

As seen in FIG. 7, the lamp can be U shaped. When the lamp has a U shape, the lamp still has two ends, namely a left end and a right end. The driver can be made into two parts.

The invention claimed is:

1. A modular LED lamp system comprising:

a cover;

a driver mounted to either a first driver mount or a second driver mount, wherein the driver has a mechanical and electrical connection to either the first driver mount in a first mode or the second driver mount in a second mode;

a circuit board, wherein the circuit board has with an LED array mounted to the circuit board, wherein the circuit board includes a first driver mount;

a left electrical connector body connecting to a left end of the cover;

a right electrical connector body connecting to a right end of the cover; and a second driver mount formed on either the left electrical connector body, or the right electrical connector body.

2. The modular LED lamp system of claim 1, wherein the circuit board fits in a slot formed on the cover, wherein the circuit board has a pair of indents including a first snap retainer indent and a second snap retainer indent, wherein a first snap retainer formed on the cover engages the first snap retainer indent, wherein a second snap retainer formed on the cover engages the second snap retainer indent.

3. The modular LED lamp system of claim 2, wherein the cover is either plastic or glass.

4. The modular LED lamp system of claim 2, wherein the LED array is mounted to a circuit board and is elongated, wherein the driver is mounted to both the first driver mount and the second driver mount, wherein the driver is made in two parts.

5. The modular LED lamp system of claim 2, wherein the first driver mounting area and the second driver mounting area are slot shaped.

6. The modular LED lamp system of claim 2, wherein the left electrical connector body has a snap connection with the cover, wherein the right electrical connector body has a snap connection with the cover, and wherein the circuit board has a snap connection to the cover.

7. The modular LED lamp system of claim 1, wherein the circuit board in a slot formed on the cover, wherein the circuit board further comprises a first driver module, wherein the first driver mount is formed on the first driver module, wherein the first driver module has a first driver module snap retainer indent and a second driver module snap retainer indent, wherein the first driver module snap retainer indent engages to a first driver module snap retainer formed on the cover, wherein the second driver module snap retainer indent engages to a second driver module snap retainer formed on the cover.

8. The modular LED lamp system of claim 7, wherein the cover is either plastic or glass.

9. The modular LED lamp system of claim 7, wherein the LED array is mounted to a circuit board and is elongated.

10. The modular LED lamp system of claim 7, wherein the first driver mounting area and the second driver mounting area are slot shaped.

11. The modular LED lamp system of claim 7, wherein the left electrical connector body has a snap connection with the cover, wherein the right electrical connector body has a snap connection with the cover, and wherein the circuit board has a snap connection to the cover.

12. The modular LED lamp system of claim 1, wherein the circuit board fits in a slot formed on the cover, wherein the circuit board has a pair of indents including a first snap retainer indent, wherein a first snap retainer formed on the cover engages the first snap retainer indent; wherein the circuit board further comprises a first driver module, wherein the first driver mount is formed on the first driver module, wherein the first driver module has a first driver module snap retainer indent, wherein the first driver module snap retainer indent engages to a first driver module snap retainer formed on the cover.

13. The modular LED lamp system of claim 12, wherein the cover is either plastic or glass, wherein the circuit board has a pair of indents including a first snap retainer indent and a second snap retainer indent, wherein a second snap retainer formed on the cover engages the second snap retainer indent, wherein the first driver module has a driver module second snap retainer indent, wherein the driver module second snap retainer indent engages to a second driver module snap retainer formed on the cover.

14. The modular LED lamp system of claim 12, wherein the LED array is mounted to a circuit board and is elongated.

15. The modular LED lamp system of claim 12, wherein the first driver mounting area and the second driver mounting area are slot shaped.

16. The modular LED lamp system of claim 12, wherein the left electrical connector body has a snap connection with the cover, wherein the right electrical connector body has a snap connection with the cover, and wherein the circuit board has a snap connection to the cover.

17. The modular LED lamp system of claim 1, further including a left electrical connector first socket formed on the circuit board that receives a left electrical connector first inside contact formed on the left electrical connector body.

18. The modular LED lamp system of claim 17, further including a right electrical connector first socket formed on the circuit board that receives a right electrical connector first inside contact formed on the right electrical connector body.

19. The modular LED lamp system of claim 17, further including snap hooks that retain the left electrical connector body and the right electrical connector body to the circuit board to maintain electrical contact.

20. The modular LED lamp system of claim 17, further including a right electrical connector second socket formed on the circuit board that receives a right electrical connector second inside contact formed on the right electrical connector body and a left electrical connector second socket formed on the circuit board that receives a left electrical connector second inside contact formed on the left electrical connector body.

* * * * *